US008967073B2

(12) United States Patent
Wakita

(10) Patent No.: US 8,967,073 B2
(45) Date of Patent: Mar. 3, 2015

(54) LIQUID DISCHARGE APPARATUS WITH CUTTER AND LIQUID DISCHARGE METHOD

(75) Inventor: Masaaki Wakita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 52 days.

(21) Appl. No.: 13/332,184

(22) Filed: Dec. 20, 2011

(65) Prior Publication Data

US 2012/0164333 A1 Jun. 28, 2012

(30) Foreign Application Priority Data

Dec. 27, 2010 (JP) ..... 2010-290566

(51) Int. Cl.

| | |
|---|---|
| ***B05C 11/00*** | (2006.01) |
| ***B41J 2/01*** | (2006.01) |
| ***B41J 11/66*** | (2006.01) |
| ***B41J 11/70*** | (2006.01) |
| ***B26D 5/02*** | (2006.01) |
| ***B26D 1/04*** | (2006.01) |

(52) U.S. Cl.

CPC ..... *B41J 11/706* (2013.01); *B26D 5/02* (2013.01); *B41J 11/66* (2013.01); *B26D 1/045* (2013.01); *B41J 11/70* (2013.01); *B05C 11/00* (2013.01)

USPC ..... 118/35; 118/37; 118/42; 347/16; 347/29; 347/102; 347/104; 101/226

(58) Field of Classification Search

USPC ..... 118/35–43; 347/102, 104, 16, 29; 400/621

See application file for complete search history.

(56) References Cited

U.S. PATENT DOCUMENTS

| | | | | |
|---|---|---|---|---|
| 4,701,063 | A * | 10/1987 | Wysk et al. | 101/226 |
| 5,537,135 | A | 7/1996 | Hevenor et al. | |
| 2003/0210290 | A1* | 11/2003 | Suzuki et al. | 347/9 |
| 2008/0100654 | A1* | 5/2008 | Kitahara et al. | 347/12 |
| 2010/0321453 | A1* | 12/2010 | Baba | 347/102 |
| 2011/0310204 | A1 | 12/2011 | Ohnishi | |

FOREIGN PATENT DOCUMENTS

| | | | |
|---|---|---|---|
| EP | 0607539 | | 7/1994 |
| JP | 10-181126 | | 7/1998 |
| JP | 2001010132 | A * | 1/2001 |
| JP | 2006-281684 | | 10/2006 |
| JP | 2010-195002 | | 9/2010 |
| JP | 2010-012625 | | 10/2010 |
| JP | 2011-005657 | | 1/2011 |

* cited by examiner

*Primary Examiner* — Dah-Wei D Yuan
*Assistant Examiner* — Binu Thomas
(74) *Attorney, Agent, or Firm* — Workman Nydegger

(57) ABSTRACT

A liquid discharge apparatus includes a transportation portion which transports a medium in a transportation direction, a cutting portion which moves in an intersection direction intersecting with the transportation direction and cuts the medium, and a head portion which is provided so as to be aligned with the cutting portion in the intersection direction, has a cutout portion on which the cutting portion is arranged, moves in the intersection direction and discharges liquid onto the medium.

6 Claims, 7 Drawing Sheets

LIQUID DISCHARGE APPARATUS WITH CUTTER AND LIQUID DISCHARGE METHOD

The entire disclosure of Japanese Patent Application No. 2010-290566, filed Dec. 27, 2010 is expressly incorporated by reference herein.

BACKGROUND

1. Technical Field

The present invention relates to a liquid discharge apparatus, and a liquid discharge method.

2. Related Art

Liquid discharge apparatuses such as an ink jet printer have been already well known.

Among the liquid discharge apparatuses, there is a liquid discharge apparatus which includes a transportation portion which transports a medium in a transportation direction, a head portion which moves in an intersection direction intersecting with the transportation direction and discharges liquid onto the medium, and a cutting portion which moves in the intersection direction and cuts the medium. In the liquid discharge apparatus, the head portion and the cutting portion are provided so as to be aligned in the intersection direction.

JP-A-2006-281684 is an example of related art.

In the above liquid discharge apparatus, a width of the liquid discharge apparatus in the intersection direction is required to be large because the head portion and the cutting portion are provided so as to be aligned in the intersection direction. Therefore, the liquid discharge apparatus has been increased in size in some case.

SUMMARY

An advantage of some aspects of the invention is to realize a liquid discharge apparatus reduced in size.

A liquid discharge apparatus includes a transportation portion which transports a medium in a transportation direction, a head portion which moves in an intersection direction intersecting with the transportation direction and discharges liquid onto the medium, and a cutting portion which moves in the intersection direction and cuts the medium, the head portion and the cutting portion being provided so as to be aligned in the intersection direction. In the liquid discharge apparatus, the head portion has a cutout portion on which the cutting portion is arranged.

With this configuration, a liquid discharge apparatus reduced in size can be realized.

It is preferable that the cutting portion have a cutter carriage and a cutter included in the cutter carriage, and the cutout portion be a portion on which the cutter is arranged.

With this configuration, a region on which the cutter can cut in the intersection direction can be enlarged.

It is preferable that the head portion have a head carriage having the cutout portion, and a first head and a second head which are included in the head carriage and are provided at positions which are different from each other in both of the transportation direction and the intersection direction, the first head be located at an upstream side with respect to the second head in a first direction toward the cutting portion from the head portion in the intersection direction, and the cutout portion be located at a position aligned with the first head at a downstream side with respect to the first head in the first direction.

With this configuration, an empty space can be effectively utilized.

Next, a liquid discharging method onto a medium using a liquid discharge apparatus, the method including; discharging liquid onto a medium. The liquid discharge apparatus includes a transportation portion which transports a medium in a transportation direction, a head portion which moves in an intersection direction intersecting with the transportation direction and discharges liquid onto the medium, and a cutting portion which moves in the intersection direction and cuts the medium, the head portion and the cutting portion being provided so as to be aligned in the intersection direction, and the head portion has a cutout portion on which the cutting portion is arranged.

With this method, a liquid discharge apparatus reduced in size can be realized.

BRIEF DESCRIPTION OF THE DRAWINGS

The invention will be described with reference to the accompanying drawings, wherein like numbers reference like elements.

FIG. 6 is a descriptive schematic view for explaining a first variation of configurations of the head unit and the cutter unit, and the like.

FIG. 7 is a descriptive schematic view for explaining a second variation of configurations of the head unit and the cutter unit, and the like.

FIG. 8 is a descriptive schematic view for explaining a third variation of configurations of the head unit and the cutter unit, and the like.

FIG. 9 is a descriptive schematic view for explaining a fourth variation of configurations of the head unit and the cutter unit, and the like.

FIG. 10 is a descriptive schematic view for explaining a fifth variation of configurations of the head unit and the cutter unit, and the like.

FIG. 11 is a descriptive schematic view for explaining a sixth variation of configurations of the head unit and the cutter unit, and the like.

FIG. 12 is a descriptive schematic view for explaining a seventh variation of configurations of the head unit and the cutter unit, and the like.

DESCRIPTION OF EXEMPLARY EMBODIMENTS

At least following matters will be clarified from the present specification and accompanying drawings.

Configuration Example of Printer 1 According to the Embodiment

An ink jet printer (hereinafter, referred to as printer 1) as an example of a liquid discharge apparatus prints an image (for example, unit image to be cut out later for use, (as an example of the unit image, a seal-like printed material to be bonded onto a plastic wrap for fresh food is cited)) on a band-form roll sheet S as an example of a medium in an ink jet system. The roll sheet S is a continuous sheet with a release sheet (that is, a glue surface of an adhesive sheet is protected with the release sheet), for example. Images which are to be printed materials are continuously printed in the direction to which the roll sheet S continues.

The printer 1 according to the embodiment includes a universal cutter (hereinafter, simply referred to as cutter 42). The printer 1 prints an image on the roll sheet S, and then, feeds backward the roll sheet S and cuts the roll sheet S (in the embodiment, cuts only the adhesive sheet of the adhesive sheet and the release sheet of the roll sheet S (making cuts only on the adhesive sheet)).

Figure 1:
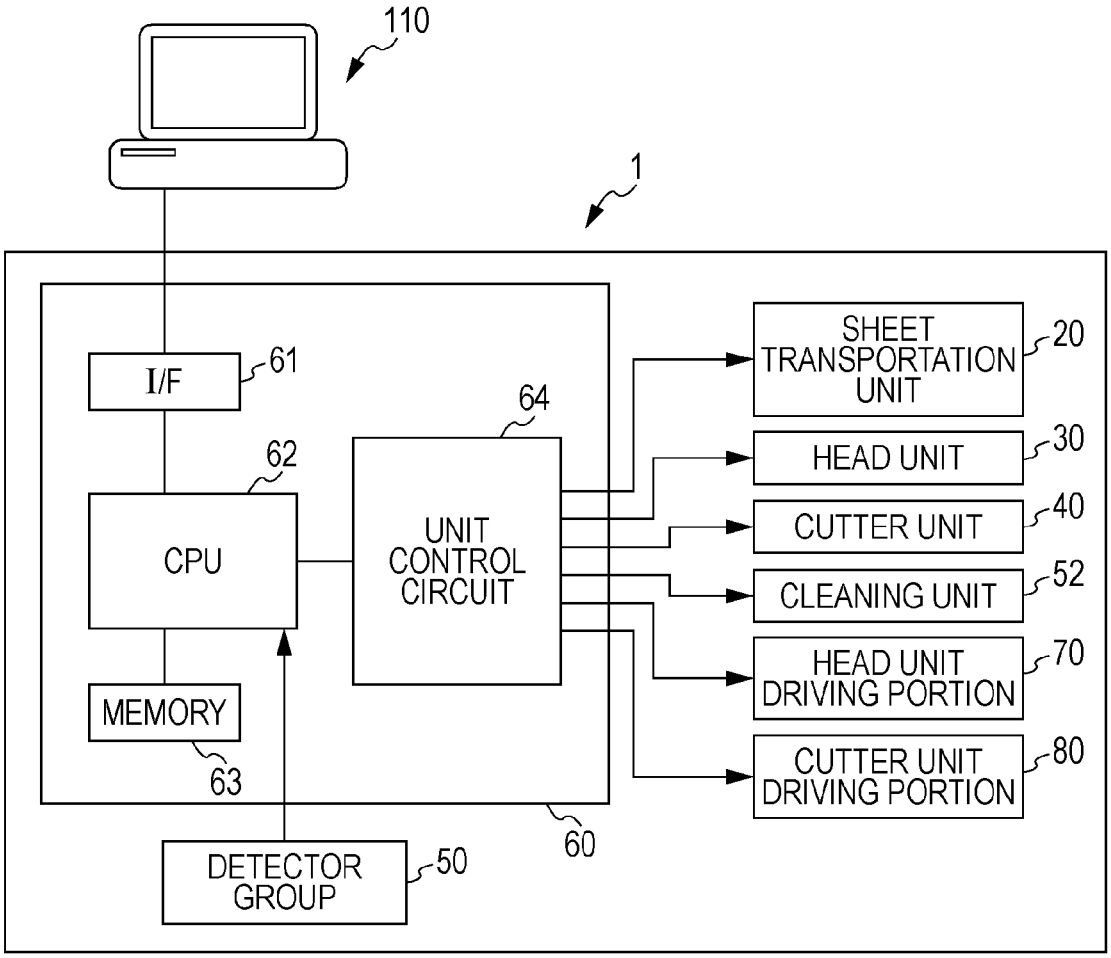
FIG. 1 is a block diagram illustrating an entire configuration of a printer.
Figure 2:
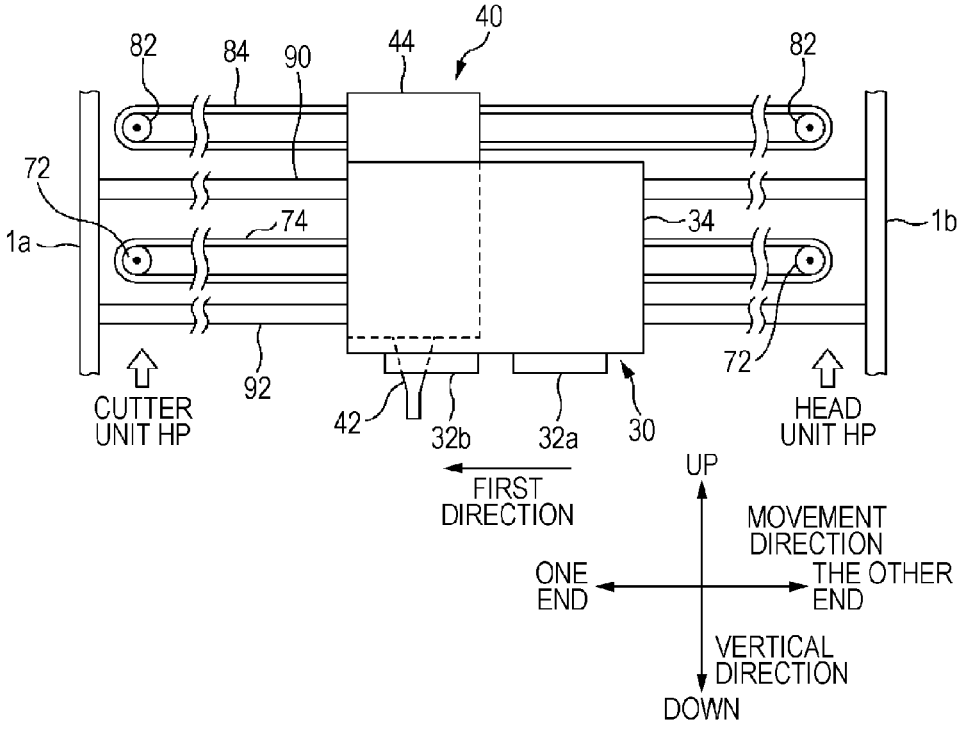
FIG. 2 is a front schematic view illustrating a head unit, a cutter unit, and peripheral members thereof.
Figure 3:
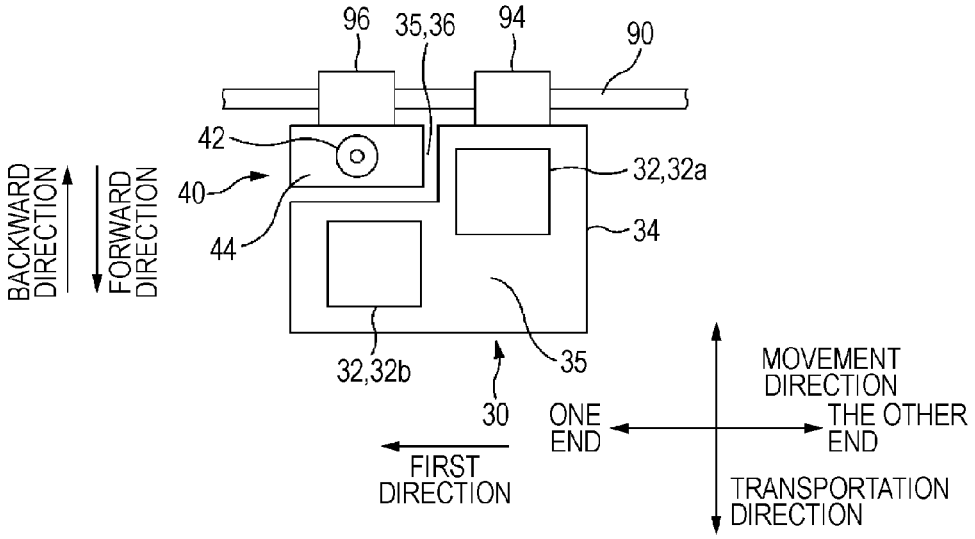
FIG. 3 is a top schematic view illustrating the head unit, the cutter unit, and the peripheral members thereof.
Figure 4:
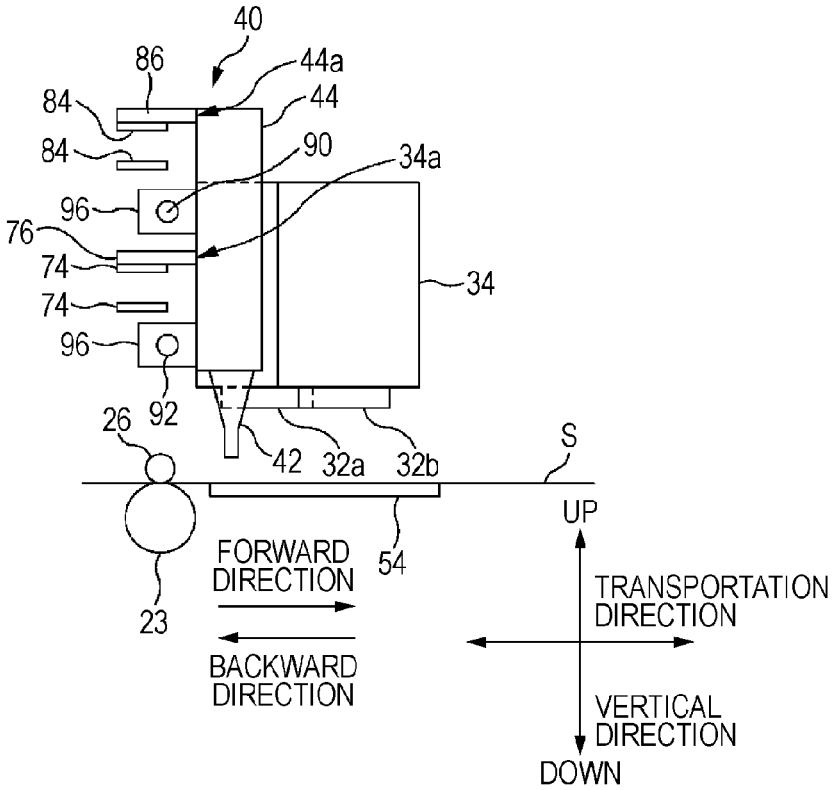
FIG. 4 is a side schematic view illustrating the head unit, the cutter unit, and the peripheral members thereof.
Figure 5:
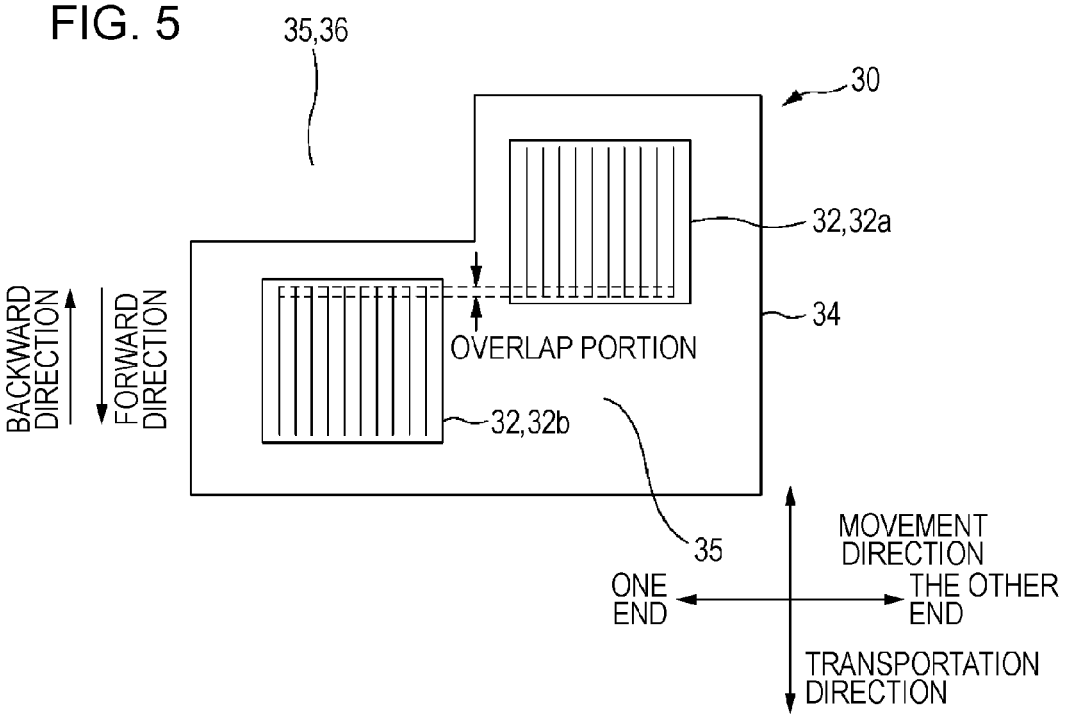
FIG. 5 is a schematic view illustrating arrangement of nozzle rows on heads.

Hereinafter, a configuration example of the printer 1 according to the embodiment which is an ink jet printer with a universal cutter is described with reference to FIG. 1 to FIG. 5. FIG. 1 is a block diagram illustrating the entire configuration of the printer 1. FIG. 2 is a front schematic view illustrating a head unit 30, a cutter unit 40, and peripheral members thereof. FIG. 3 is a top schematic view illustrating the head unit 30, the cutter unit 40, and the peripheral members thereof. FIG. 4 is a side schematic view illustrating the head unit 30, the cutter unit 40, and the peripheral members thereof. FIG. 5 is a schematic view illustrating arrangement of nozzle rows on heads 32.

In order to make the drawings be understood easily, the roll sheet S, a transportation roller 23, a head unit driving force application portion 76, a cutter unit driving force application portion 86, and the like are not illustrated in FIG. 2 and FIG. 3. Further, a head unit belt 74, a cutter unit belt 84, and the like are not illustrated in FIG. 3. In FIG. 3, the heads 32 and the cutter 42 which can be observed only from the bottom are illustrated so as to be observed from the above. In the same manner, in FIG. 5, the heads 32 and the nozzle rows which can be observed only from the bottom are illustrated so as to be observed from the above. The peripheral members of the head unit 30 and the cutter unit 40 as illustrated in FIG. 2 to FIG. 4 correspond to a head unit driving portion 70, a cutter unit driving portion 80, a first guide rail 90, a second guide rail 92, a head unit supporting member 94, and a cutter unit supporting member 96, for example.

As illustrated in FIG. 1, the printer 1 includes a sheet transportation portion 20 as an example of a transportation portion, the head unit 30 as an example of a head portion, the head unit driving portion 70 as an example of a first driving portion, the cutter unit 40 as an example of a cutting portion, the cutter unit driving portion 80 as an example of a second driving portion, a cleaning unit 52, a platen 54, a detector group 50, and a controller 60.

The printer 1 which has received print data and cut data from a computer 110 as an external device controls each part (the sheet transportation portion 20, the head unit 30, the head unit driving portion 70, the cutter unit 40, the cutter unit driving portion 80, the cleaning unit 52) using the controller 60. The controller 60 controls each part based on the print data received from the computer 110 so as to print an image on the roll sheet S. Thereafter, the controller 60 controls each part based on the cut data received from the computer 110 so as to cut the roll sheet S. A state in the printer 1 is monitored by the detector group 50 and the detector group 50 outputs a detection result to the controller 60. The controller 60 controls each part based on the detection result output from the detector group 50.

The sheet transportation portion 20 is a member for transporting the roll sheet S in the transportation direction. The sheet transportation portion 20 includes a transportation motor (not illustrated), the transportation roller 23, and a driven roller 26.

The transportation roller 23 is a roller which transports the roll sheet S. The transportation roller 23 is driven by the transportation motor. As illustrated in FIG. 4, when the transportation roller 23 transports the roll sheet S, the roll sheet S is nipped between the transportation roller 23 and the driven roller 26 (that is to say, the driven roller 26 is arranged so as to be opposed to the transportation roller 23 while nipping the roll sheet S therebetween).

When an image is printed on the roll sheet S, the transportation roller 23 intermittently transports the roll sheet S in a forward direction (see, FIG. 3 and FIG. 4) in the transportation direction. After the image has been printed, the transportation roller 23 continuously transports the roll sheet S in a backward direction (see, FIG. 3 and FIG. 4) in the transportation direction, that is, feeds back the roll sheet S. Thereafter, when the roll sheet S is cut, the transportation roller 23 continuously transports the roll sheet S in the forward direction and the backward direction. That is to say, when the cutter unit 40 (the cutter 42) cuts the roll sheet S, the transportation roller 23 transports the roll sheet S in the transportation direction (forward direction or backward direction) so as to adjust a cutting position of the roll sheet S.

The head unit 30 moves in the intersection direction (hereinafter, also referred to as movement direction) intersecting with the transportation direction and discharges ink as an example of liquid onto the roll sheet S. As illustrated in FIG. 3 and FIG. 5, the head unit 30 has two heads 32 (that is, first head 32*a* and second head 32*b*), and a head carriage 34.

The first head 32*a* and the second head 32*b* are included in the head carriage 34 (at a lower portion therein). Nozzle rows on which nozzles are lined in the transportation direction are provided on lower faces of the first head 32*a* and the second head 32*b*, as illustrated in FIG. 5. In the embodiment, ten nozzle rows are provided for each color of yellow (Y), magenta (M), cyan (C), black (K), and the like on each of the heads 32. The ten nozzle rows are arranged at an interval in the movement direction.

As illustrated in FIG. 3 and FIG. 5, the first head 32*a* and the second head 32*b* are provided at positions which are different from each other in both of the transportation direction and the movement direction. That is to say, the first head 32*a* is located at a position deviated from the second head 32*b* when coordinates are taken in the transportation direction and is also located at a position deviated from the second head 32*b* when coordinates are taken in the movement direction. If the first head 32*a* and the second head 32*b* are arranged in this manner, a part of the nozzle rows on the first head 32*a* (to be more specific, a part at the downstream side in the forward direction) and a part of the nozzle rows on the second head 32*b* (to be more specific, a part at the upstream side in the forward direction) can be overlapped with each other in the transportation direction. Ink can be discharged by selecting any of the first head 32*a* and the second head 32*b* on the overlapped part so that image quality can be suppressed from being largely changed at a joint. As illustrated in FIG. 4, the first head 32*a* is located at a position closer to the transportation roller 23 (and the driven roller 26) in comparison with the second head 32*b* in the transportation direction.

A piezoelectric element (not illustrated) as a driving element for discharging ink is provided on each nozzle. If a voltage at a predetermined time interval is applied between electrodes provided on both ends of each piezoelectric element, the piezoelectric element expands in accordance with an application time of the voltage so as to deform a side wall of an ink flow path. With this, a volume of the ink flow path is contracted in accordance with the expansion and contraction of the piezoelectric element and ink corresponding to the contraction amount is discharged through each nozzle of each color as ink droplets.

A valve unit (not illustrated) is connected to each head 32 through an ink supply tube. The valve unit is a portion in which ink is primarily stored.

The head carriage 34 supports the heads 32 and receives a driving force from the head unit driving portion 70 so as to reciprocate in the movement direction along the first guide rail 90 and the second guide rail 92 together with the heads 32. For convenience of description, a direction toward the cutter unit 40 from the head unit 30 in the movement direction is referred to as a first direction (see, FIG. 3 and the like).

As illustrated in FIG. 3 and FIG. 5, the head carriage 34 has a shape that a corner is cut out from a rectangular shape when seen from the above. Note that the cutout portion 36 also has a rectangular shape. As illustrated in FIG. 3, the cutter unit 40 can be located at the cutout portion 36. That is to say, the head unit 30 (to be more specific, the head carriage 34) has the cutout portion 36 on which the cutter unit 40 is arranged.

As described above, the first head 32*a* and the second head 32*b* are provided at the positions which are different from each other in both of the transportation direction and the movement direction. In the embodiment, the first head 32*a* is located at the upstream side with respect to the second head 32*b* in the forward direction and the first head 32*a* is located at the upstream side with respect to the second head 32*b* in the first direction. Therefore, as illustrated in FIG. 3, two empty portions 35 (empty portions on which the heads 32 are not located) are present on the head carriage 34. The cutout portion 36 is formed by using one of the two empty portions 35. To be more specific, as illustrated in FIG. 3, the cutout portion 36 is located at a position aligned with the second head 32*b* at the upstream side with respect to the second head 32*b* in the forward direction and is located at a position aligned with the first head 32*a* at the downstream side with respect to the first head 32*a* in the first direction.

The head carriage 34 is supported by the first guide rail 90 and the second guide rail 92 through the head unit supporting member 94. The head carriage 34 is supported so as to reciprocate along the first guide rail 90 and the second guide rail 92 in the movement direction. The first guide rail 90 and the second guide rail 92 engage with the head carriage 34 (the head unit 30) through the head unit supporting member 94 and guide movement of the head carriage 34 (the head unit 30) in the movement direction. The first guide rail 90 and the second guide rail 92 are long bar-shaped members extending in the movement direction and the second guide rail 92 is provided to be in parallel with the first guide rail 90. Both of the first guide rail 90 and the second guide rail 92 are provided side by side in the vertical direction (in the embodiment, the second guide rail 92 is located at a lower side with respect to the first guide rail 90 in the vertical direction). As illustrated in FIG. 2, one ends of the guide rails are fixed to one end 1*a* of a housing of the printer 1 in the movement direction. The other ends of the guide rails are fixed to the other end 1*b* of the housing of the printer 1 in the movement direction.

The head unit driving portion 70 drives the head unit 30 so as to move the head unit 30 in the movement direction. As illustrated in FIG. 2 and FIG. 4, the head unit driving portion 70 has a head unit motor (not illustrated), two head unit pulleys 72, the head unit belt 74, and the head unit driving force application portion 76.

The head unit motor is connected to one of the two head unit pulleys 72 through a belt (not illustrated). As illustrated in FIG. 2, the head unit belt 74 is stretched over the two head unit pulleys 72. As illustrated in FIG. 4, the head unit driving force application portion 76 for applying a driving force of the head unit motor to the head unit 30 is fixed to the head unit belt 74. Further, the head unit driving force application portion 76 is connected to the head unit 30 (to be more specific, the head carriage 34).

If the head unit motor is operated, the head unit pulleys 72 are rotated. Further, the head unit belt 74 is also rotated with the rotation of the head unit pulleys 72. If the head unit belt 74 is rotated, the head unit driving force application portion 76 fixed to the head unit belt 74 moves in the movement direction. If the head unit driving force application portion 76 moves in the movement direction, the head unit 30 connected to the head unit driving force application portion 76 also moves in the movement direction.

Thus, the driving force of the head unit motor is transmitted to the head unit driving force application portion 76 through the head unit pulleys 72, and the head unit belt 74. Then, the head unit driving force application portion 76 applies the driving force to the head unit 30. The head unit 30 which has received the driving force from the head unit driving force application portion 76 moves along the first guide rail 90 and the second guide rail 92 in the movement direction.

As illustrated in FIG. 2 and FIG. 4, the head unit pulleys 72, the head unit belt 74, and the head unit driving force application portion 76 are located between the first guide rail 90 and the second guide rail 92 in a predetermined direction (in the embodiment, the vertical direction) toward the second guide rail 92 from the first guide rail 90. Therefore, as illustrated in FIG. 4, a portion (referred to as head unit driving force reception portion 34*a* for convenience of description) of the head unit (to be more specific, the head carriage 34), which receives the driving force from the head unit driving portion 70 (to be more specific, the head unit driving force application portion 76), is also located between the first guide rail 90 and the second guide rail 92 in the predetermined direction (the vertical direction).

The cutter unit 40 is a member which moves in the movement direction and cuts the roll sheet S. The cutter unit 40 and the head unit 30 are provided so as to be aligned in the movement direction as illustrated in FIG. 3. In other words, the cutter unit 40 also cannot move to the opposite side of the head unit 30 beyond the head unit 30 in the movement direction. Further, the head unit 30 cannot move to the opposite side of the cutter unit 40 beyond the cutter unit 40 in the movement direction. As illustrated in FIG. 2 to FIG. 4, the cutter unit 40 has the cutter 42 and a cutter carriage 44.

The cutter 42 is included in the cutter carriage 44 (at a lower portion therein). The cutter 42 is provided so as to move with respect to the cutter carriage 44 in the vertical direction. With the function, when a cutting position on the roll sheet S is changed without cutting the roll sheet S, the cutter 42 is located at an upper position at which the cutter 42 does not make contact with the roll sheet S. When the roll sheet S is cut, the cutter 42 is located at a lower position at which the cutter 42 makes contact with the roll sheet S. The cutter 42 can rotate with respect to the cutter carriage 44. The cutter 42 can be made to rotate for making a direction of a blade of the cutter 42 changeable.

The cutter carriage 44 supports the cutter 42 and receives a driving force from the cutter unit driving portion 80 so as to reciprocate along the first guide rail 90 and the second guide rail 92 in the movement direction together with the cutter 42.

As illustrated in FIG. 3, the cutter carriage 44 has a rectangular shape when seen from the above and supports the cutter 42 at a center in the movement direction. The cutter carriage 44 can be located at the above-described cutout portion 36. In the embodiment, as illustrated in FIG. 3, the entire cutter carriage 44 can be located at the cutout portion 36 so that the cutter 42 is also located at the cutout portion 36 when the cutter carriage 44 is located at the cutout portion 36. That is to say, the cutout portion 36 is also a portion on which the cutter 42 is arranged.

When the cutter carriage 44 is located at the cutout portion 36, the cutter carriage 44 is located at a position aligned with the second head 32*b* at the upstream side with respect to the second head 32*b* in the forward direction and is located at a position aligned with the first head 32*a* at the downstream side with respect to the first head 32*a* in the first direction, as illustrated in FIG. 3.

The cutter carriage 44 is supported by the first guide rail 90 and the second guide rail 92 as described above through the cutter unit supporting member 96. The cutter carriage 44 is supported so as to be reciprocatable along the first guide rail 90 and the second guide rail 92 in the movement direction. The first guide rail 90 and the second guide rail 92 engage with the cutter carriage 44 (the cutter unit 40) through the cutter unit supporting member 96 and guide movement of the cutter carriage 44 (the cutter unit 40) in the movement direction. That is to say, the cutter unit 40 and the head unit 30 are guided by common guide rails (that is, the first guide rail 90 and the second guide rail 92).

The cutter unit driving portion 80 is a member which drives the cutter unit 40 and moves the cutter unit 40 in the movement direction. As illustrated in FIG. 2 and FIG. 4, the cutter unit driving portion 80 has a cutter unit motor (not illustrated), two cutter unit pulleys 82, the cutter unit belt 84, and the cutter unit driving force application portion 86.

The cutter unit motor is connected to one of the two cutter unit pulleys 82 through a belt (not illustrated). As illustrated in FIG. 2, the cutter unit belt 84 is stretched over the two cutter unit pulleys 82. As illustrated in FIG. 4, the cutter unit driving force application portion 86 for applying a driving force of the cutter unit motor to the cutter unit 40 is fixed to the cutter unit belt 84. Further, the cutter unit driving force application portion 86 is connected to the cutter unit 40 (to be more specific, the cutter carriage 44).

If the cutter unit motor is operated, the cutter unit pulleys 82 are rotated. Further, the cutter unit belt 84 is also rotated with the rotation of the cutter unit pulleys 82. If the cutter unit belt 84 is rotated, the cutter unit driving force application portion 86 fixed to the cutter unit belt 84 moves in the movement direction. If the cutter unit driving force application portion 86 moves in the movement direction, the cutter unit 40 connected to the cutter unit driving force application portion 86 also moves in the movement direction.

Thus, the driving force of the cutter unit motor is transmitted to the cutter unit driving force application portion 86 through the cutter unit pulleys 82, and the cutter unit belt 84. Then, the cutter unit driving force application portion 86 applies the driving force to the cutter unit 40. The cutter unit 40 which has received the driving force from the cutter unit driving force application portion 86 moves along the first guide rail 90 and the second guide rail 92 in the movement direction.

As illustrated in FIG. 2 and FIG. 4, the cutter unit pulleys 82, the cutter unit belt 84, and the cutter unit driving force application portion 86 are located at the outer side of the first guide rail 90 and the second guide rail 92 in the predetermined direction (in the embodiment, in the vertical direction). That is to say, the cutter unit pulleys 82, the cutter unit belt 84, and the cutter unit driving force application portion 86 are located at the opposite side to the second guide rail 92 when seen from the first guide rail 90 or at the upper side of the first guide rail 90 when seen from the second guide rail 92. Therefore, as illustrated in FIG. 4, a portion (referred to as cutter unit driving force reception portion 44*a* for convenience of description) of the cutter unit 40 (to be more specific, the cutter carriage 44), which receives the driving force from the cutter unit driving portion 80 (to be more specific, the cutter unit driving force application portion 86), is also located at the opposite side to the second guide rail 92 when seen from the first guide rail 90 or at the upper side of the first guide rail 90 when seen from the second guide rail 92. In the embodiment, the cutter unit driving force reception portion 44*a* is located at the former side, that is, upper side with respect to the first guide rail 90) in the predetermined direction (the vertical direction).

The head unit 30 and the cutter unit 40 configured as described above are operated in the following manner when an image is printed on the roll sheet S. That is to say, the head unit 30 discharges ink through nozzles while moving in the movement direction and executes an operation of forming raster lines along the movement direction. Such operation and the operation of intermittently transporting the roll sheet S in the forward direction by the above-described transportation roller 23 are repeated so that an image is printed. At this time (when an image is printed on the roll sheet S), the cutter unit 40 is located at a cutter unit home position (cutter unit HP, see, FIG. 2) provided at one end in the movement direction in a still state.

The head unit 30 and the cutter unit 40 are operated in the following manner when the roll sheet S is cut. That is to say, the cutter unit 40 executes an operation of cutting the roll sheet S while moving in the movement direction or in a still state in the movement direction. When the roll sheet S is cut in the state where the cutter unit 40 is still in the movement direction, the roll sheet S is required to be transported in the transportation direction. At this time (when the roll sheet S is cut), the head unit 30 is located at a head unit home position (head unit HP, see, FIG. 2) provided at the other end in the movement direction in a still state.

The cleaning unit 52 is a member for cleaning the head 32. The cleaning unit is provided at the head unit HP and has a cap and a suction pump (not illustrated). When the heads 32 (the head carriage 34) move in the movement direction and are located at the head unit HP, the cap makes close contact with lower faces of the heads 32 (nozzle faces). The suction pump is operated in a state where the cap makes close contact with the lower faces of the heads 32 in this manner, ink in the heads 32 is sucked together with ink of which viscosity has been increased and paper powder. Thus, clogged nozzles are recovered from a non-discharging state so that cleaning of the heads is completed.

The platen 54 is a member for supporting the roll sheet S. As illustrated in FIG. 4, the platen 54 is located at a position opposed to the head unit 30 and the cutter unit 40. When the roll sheet S is cut, the platen 54 also functions as a cutter table.

The controller 60 is a control unit for controlling the printer 1. As illustrated in FIG. 1, the controller 60 has an interface portion 61, a CPU 62, a memory 63, and a unit control circuit 64. The interface portion 61 is a member which transmits and receives data between the host computer 110 as an external device and the printer 1. The CPU 62 is an arithmetic processing unit for controlling the entire printer 1. The memory 63 is a member for ensuring a region in which programs of the CPU 62 are stored, an operation region, and the like. The CPU 62 controls each unit with the unit control circuit 64 in accordance with the programs stored in the memory 63.

The detector group 50 monitors a state in the printer 1. For example, the detector group 50 includes a rotary encoder used for controlling transportation of the roll sheet S, a sheet detection sensor for detecting presence/absence of the roll sheet S to be transported, a linear encoder for detecting positions of the head carriage 34 and the cutter carriage 44 in the movement direction, and the like.

Effectiveness of Printer 1 According to the Embodiment

As described above, the printer 1 according to the embodiment includes the sheet transportation portion 20 which transports the roll sheet S in the transportation direction, the head unit 30 which moves in the movement direction intersecting with the transportation direction and discharges ink on the roll sheet S, and the cutter unit 40 which moves in the movement direction and cuts the roll sheet S. The head unit 30 and the cutter unit 40 are provided so as to be aligned in the movement direction. The head unit 30 includes the cutout portion 36 on which the cutter unit 40 is arranged. With this configuration, the printer 1 reduced in size can be realized.

That is to say, in the ink jet printer with a universal cutter in which the head unit 30 and the cutter unit 40 are provided so as to be aligned in the movement direction, a movable range of the head unit 30 in the movement direction is narrower by the presence of the cutter unit 40 in comparison with a normal printer without a universal cutter. Accordingly, in order to obtain the movable range which is equivalent to that in the normal printer, a lateral width (width in the movement direction) of the ink jet printer with the universal cutter is required to be larger by the size of the cutter unit 40. Therefore, the printer is increased in size.

In response thereto, in the printer 1 according to the embodiment, the head unit 30 includes the cutout portion 36 on which the cutter unit 40 is arranged. Therefore, a width of the printer 1 in the movement direction is not required to be so large (or is not required to be large at all) in order to obtain the movable range. With this configuration, the printer 1 reduced in size can be realized.

Since the printer 1 includes the cutout portion 36, the movable range of the cutter unit 40 can be enlarged more in comparison with a case where the cutout portion 36 is not provided.

Variations of Configurations of Head Unit 30 and Cutter Unit 40, and the Like In the above embodiment, the cutout portion 36 is a portion on which the entire cutter unit 40 (the cutter carriage 44) is arranged. That is to say, as illustrated in FIG. 3, the entire cutter unit 40 (the cutter carriage 44) can be located at the cutout portion 36. However, the invention is not limited thereto.

Figure 6:
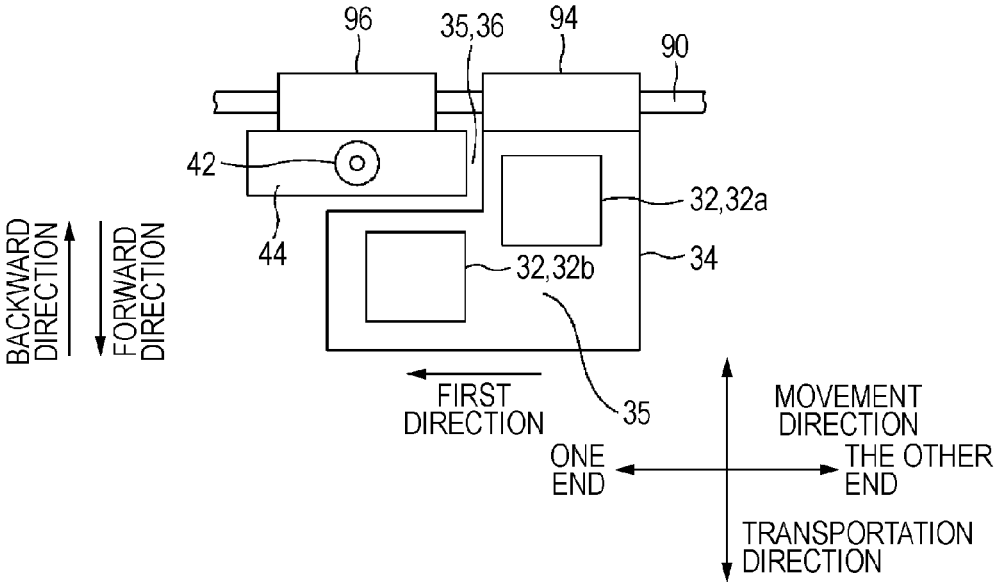

For example, as illustrated in FIG. 6, the cutout portion 36 may be configured to be a portion on which a portion of the cutter unit 40 (the cutter carriage 44) is arranged for enhancing the support for the cutter unit 40.

Figure 7:
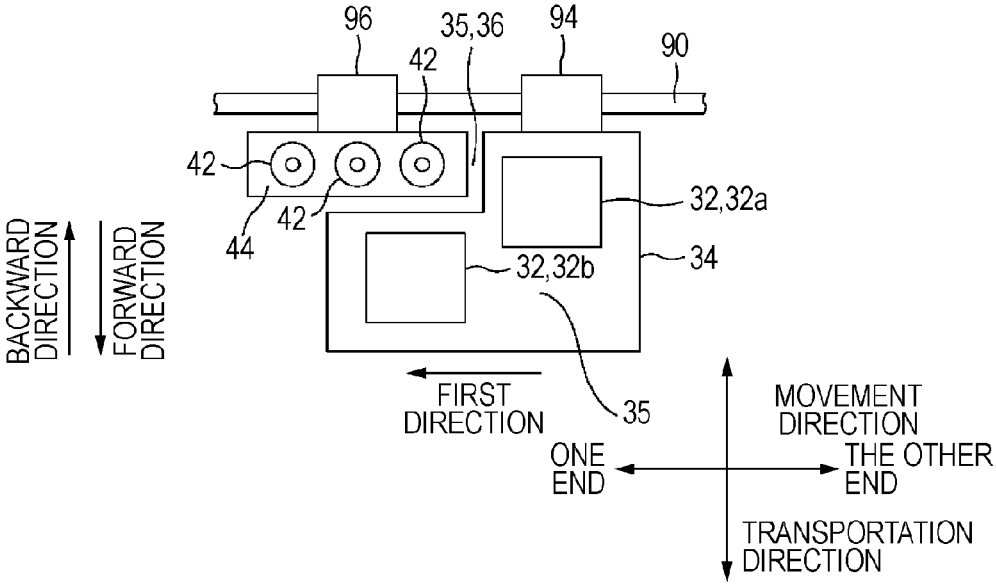

In the above embodiment, the cutter unit 40 includes only one cutter 42. However, the invention is not limited thereto. For example, as illustrated in FIG. 7, the cutter unit 40 may include a plurality of cutters 42.

In the above embodiment, the cutout portion 36 is a portion on which the cutter 42 is arranged. That is to say, the cutter unit 40 is configured such that the cutter 42 is also located at the cutout portion 36 when the cutter carriage 44 is located at the cutout portion 36. However, the invention is not limited to the configuration.

Figure 8:
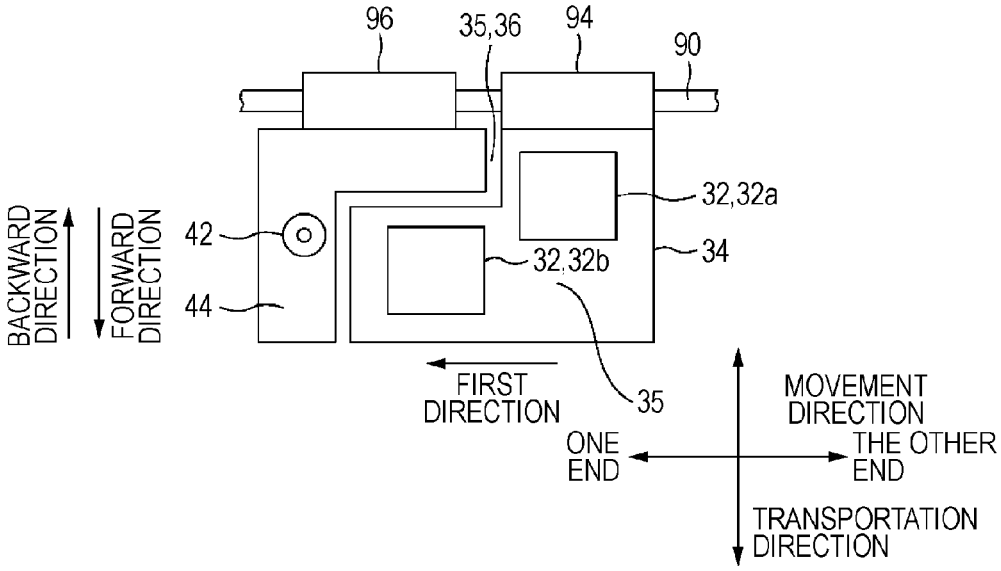

For example, as illustrated in FIG. 8, the cutout portion 36 may not be a portion on which the cutter 42 is arranged. However, the above embodiment (example as illustrated in FIG. 3) is more desirable in a point that a region on which the cutter 42 can cut in the movement direction can be enlarged more.

In the above embodiment, the head unit 30 includes the head carriage 34 having the cutout portion 36, and the first head 32*a* and the second head 32*b* which are provided at the positions which are different from each other in both of the transportation direction and the movement direction. The first head 32*a* is located at the upstream side with respect to the second head 32*b* in the first direction toward the cutter unit 40 from the head unit 30 in the movement direction. Further, the cutout portion 36 is located at the position aligned with the first head 32*a* at the downstream side with respect to the first head 32*a* in the first direction. That is to say, in the above embodiment, as illustrated in FIG. 3, the plurality of heads (the first head 32*a* and the second head 32*b*) are provided and the cutout portion 36 is located at a position aligned with the head (that is, the first head 32*a*) located at the upperstream side in the first direction in the plurality of heads and at the downstream side with respect to the head. However, the invention is not limited thereto.

Figure 9:
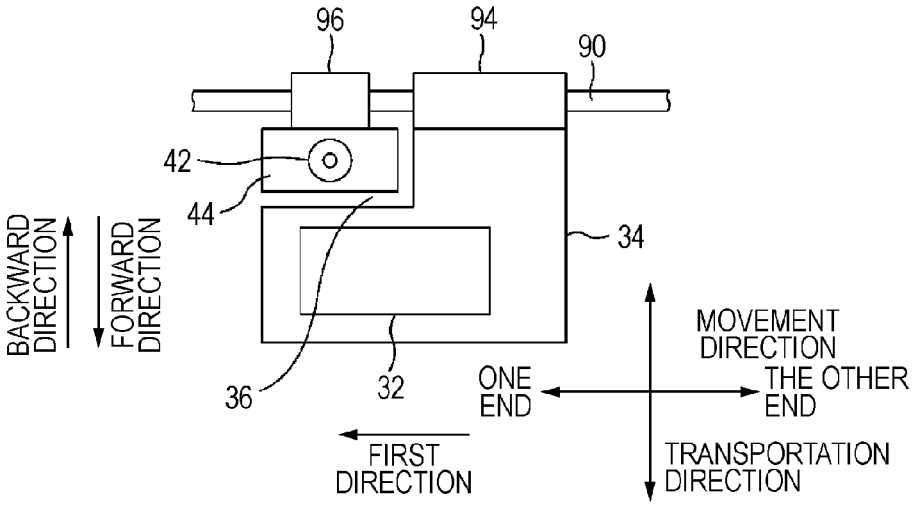

For example, as illustrated in FIG. 9, the head unit 30 may have only one head 32. However, in the above embodiment (the example as illustrated in FIG. 3), since the cutout portion 36 is formed by using the empty portion 35 generated by providing the first head 32*a* and the second head 32*b*, the empty space can be effectively utilized. Thus, the above embodiment is more desirable.

Figure 10:
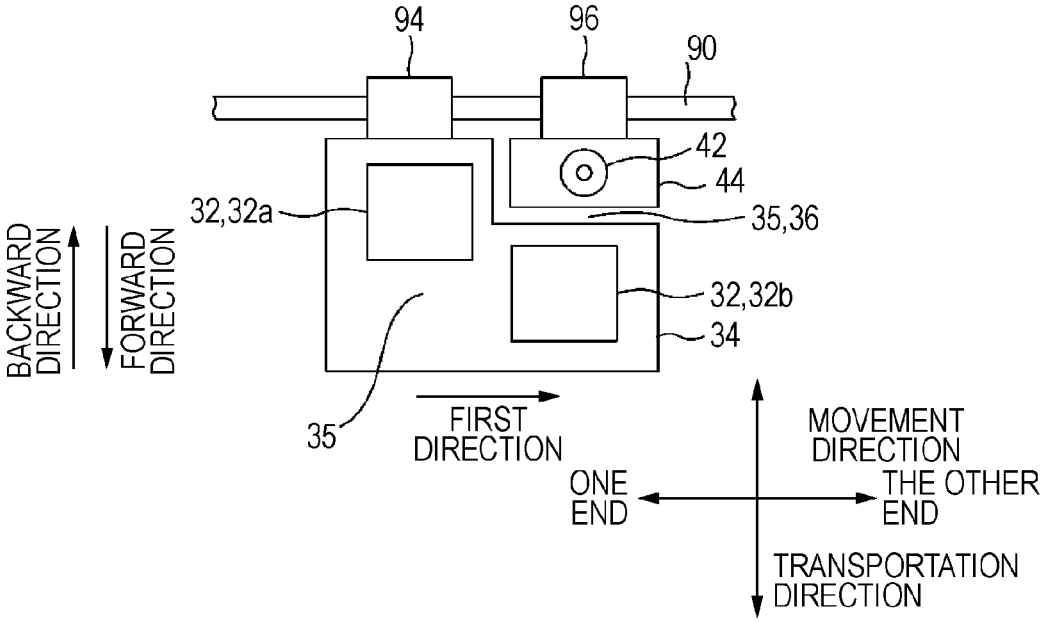
Figure 11:
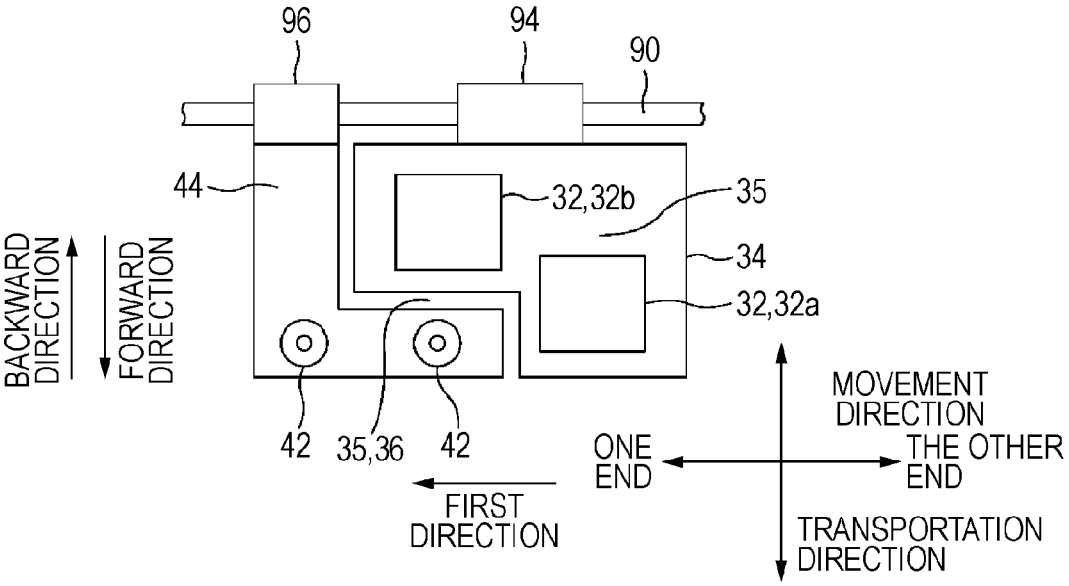
Figure 12:
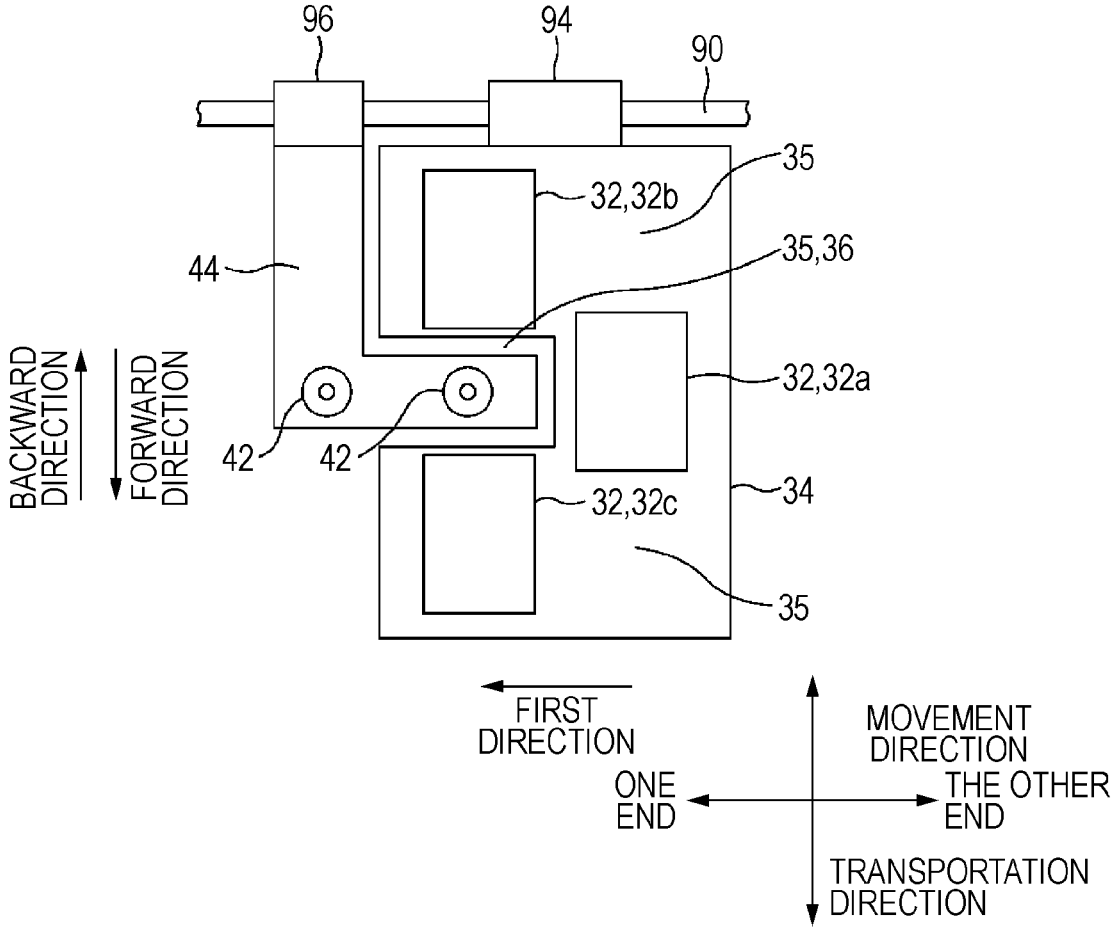

As another example of the configuration in which the cutout portion 36 is located at the position aligned with the head located at the upperstream side in the first direction in the plurality of heads and at the downstream side with respect to the head, examples as illustrated in FIG. 10 to FIG. 12 are cited.

That is to say, as illustrated in FIG. 10, the head unit 30 may be located at one end side in the movement direction and the cutter unit 40 may be located at the other end side in the movement direction unlike the example as illustrated in FIG. 3, that is, the example in which the cutter unit 40 is located at one end side in the movement direction and the head unit 30 is located at the other end side in the movement direction.

As illustrated in FIG. 11, the cutout portion 36 may be located at a position aligned with the second head 32*b* at the downstream side with respect to the second head 32*b* in the forward direction unlike the example as illustrated in FIG. 3, that is, the example in which the cutout portion 36 is located at the position aligned with the second head 32*b* at the upstream side with respect to the second head 32*b* in the forward direction.

As illustrated in FIG. 12, the number of heads 32 may be equal to or more than three unlike the example as illustrated in FIG. 3, that is, the example in which the number of heads 32 is only two. In the example of FIG. 12, three heads 32 of a first head 32*a*, a second head 32*b*, and a third head 32*c* are provided.

In other examples, an empty space can be effectively utilized by forming the cutout portion 36 using the empty portion 35.

Other Embodiments

In the above embodiment, the liquid discharge apparatus is mainly described. However, a disclosure of a liquid discharge method, and the like are included. The above embodiment makes the invention understood easily and is not intended for limiting interpretation of the invention. It is needless to say that the invention can be changed and improved without departing from the scope of the invention and the invention includes equivalents thereof. In particular, the following embodiments are included in the invention.

In the above embodiment, a liquid discharge apparatus (liquid ejecting apparatus) is embodied as the ink jet printer. However, liquid ejecting apparatuses which eject and discharge liquids other than ink may be employed. The invention can be applied to various types of liquid ejecting apparatuses including a liquid ejecting head or the like which discharges a trace amount of liquid droplets. Note that the terminology "liquid droplets" represents a state of liquid which is discharged from the above liquid ejecting apparatus. For example, a granule form, a teardrop form, and a form that pulls tails in a string-like form therebehind are included as the liquid droplets. The terminology "liquid" here represents materials which can be ejected by the liquid ejecting apparatus. For example, any materials are included as long as the materials are in a liquid phase. For example, materials in a liquid state having high viscosity or low viscosity or a fluid state such as sol, gel water, other inorganic solvents, an organic solvent, a solution, a liquid resin or a liquid metal (molten metal) can be included as the liquid. Further, the liquid is not limited to liquid as one state of a material but includes a solution, a dispersion or a mixture of particles of a functional material made of a solid material such as pigment particles or metal particles. Typical examples of the liquid are ink described in the above embodiment and liquid crystals. The terminology "ink" here encompasses various liquid compositions such as common aqueous ink and oil ink, gel ink and hot melt ink. Specific examples of the liquid ejecting apparatus include a liquid ejecting apparatus which ejects liquid in a form of a dispersion or a solution of a material such as an electrode material or a coloring material. The material such as the electrode material or the coloring material is used for manufacturing a liquid crystal display, an electroluminescence (EL) display, a surface emitting display and a color filter, for example. Further, the specific examples of the liquid ejecting apparatus include a liquid ejecting apparatus which ejects a bioorganic material used for manufacturing biochips, a liquid ejecting apparatus which ejects liquid used as a precision pipette and serving as a sample, printing equipment and a micro dispenser. Other examples of the liquid ejecting apparatus include a liquid ejecting apparatus which pinpoint-ejects lubricating oil to a precision machine such as a watch or a camera. Further, a liquid ejecting apparatus which ejects a transparent resin solution of an ultraviolet curable resin or the like onto a substrate in order to form a hemispherical microlens (optical lens) used for an optical communication element and the like is included as the liquid ejecting apparatus. In addition, a liquid ejecting apparatus which ejects an acid or alkali etching solution for etching a substrate or the like may be employed as the liquid ejecting apparatus. The invention can be applied to any one type of the liquid ejecting apparatuses.

In the above embodiment, the roll sheet S has been described as an example of a medium. However, the medium is not limited to the roll sheet S and may be a cut sheet.

A continuous sheet with a release sheet has been described as an example of the roll sheet S. However, the roll sheet S is not limited thereto and may be a plain sheet without the release sheet (in this case, the plain sheet is cut unlike the above embodiment in which only the adhesive sheet of the adhesive sheet and the release sheet of the roll sheet S is cut).

The medium is not necessarily paper and may be a film, or a fabric, for example.

In the above embodiment, the predetermined direction corresponds to the vertical direction. However, the predetermined direction is not limited thereto and may be a horizontal direction, for example. That is to say, in the above embodiment, both of the first guide rail 90 and the second guide rail 92 are provided so as to be aligned in the vertical direction and support the head unit 30 and the cutter unit 40 from the side. However, both of the first guide rail 90 and the second guide rail 92 may be provided so as to be aligned in the horizontal direction and the first guide rail 90 and the second guide rail 92 may support the head unit 30 and the cutter unit 40 from the upper side or the lower side, respectively, for example.

What is claimed is:

1. A liquid discharge apparatus comprising:

a cutting portion which moves in a first direction and cuts a medium, wherein the cutting portion has a cutter that cuts the medium; and a head portion which moves in the first direction and discharges liquid onto the medium, wherein the head portion includes:

a head carriage that includes a cutout portion, wherein the cutting portion is arranged in the cutout portion, a first head that discharges liquid onto the medium, and a second head, wherein a part of the first head and a part of the second head are provided at positions that are different from each other in both in a second direction and the first direction, wherein when the cutting portion is arranged in the cutout portion, a portion of the cutter overlaps a portion of the first head in the second direction intersecting the first direction.

2. The liquid discharge apparatus according to claim 1, wherein the cutting portion has a cutter carriage which includes the cutter.

3. The liquid discharge apparatus according to claim 1, wherein a length of the cutting portion in the first direction is longer than a length of the first head in the first direction.

4. The liquid discharge apparatus according to claim 1, wherein the cutting portion is movable in the first direction independently of the head portion.

5. A liquid discharge apparatus comprising:

a cutting portion that moves in a first direction and that cuts a medium, wherein the cutting portion includes a cutter that cuts the medium; and a head portion that moves in the first direction and that discharges liquid onto the medium, wherein the head portion includes:

a cutout portion in which the cutting portion is arranged, and a first head that discharges liquid onto the medium, wherein when the cutting portion is arranged in the cutout portion, a portion of the cutter overlaps a portion of the first head in a second direction intersecting the first direction, wherein a length of the cutting portion in the first direction is longer than a length of the first head in the first direction.

6. A liquid discharge apparatus comprising:

a cutting portion that moves in a first direction and that cuts a medium, wherein the cutting portion has a cutter that cuts the medium; and a head portion that moves in the first direction and that discharges liquid onto the medium, wherein the head portion includes:

a cutout portion in which the cutting portion is arranged, and a first head that discharges liquid onto the medium, wherein when the cutting portion is arranged in the cutout portion, a portion of the cutter overlaps a portion of the first head in a second direction intersecting the first direction, wherein the cutting portion is movable in the first direction independently of the head portion.

* * * * *